US010364976B2

(12) United States Patent
Deng

(10) Patent No.: US 10,364,976 B2
(45) Date of Patent: Jul. 30, 2019

(54) LIGHT SOURCE DEVICE FOR OUTDOOR LAMP

(71) Applicant: DONGGUAN PAN AMERICAN ELECTRONICS CO., LTD, DongGuan (CN)

(72) Inventor: Jinsheng Deng, DongGuan (CN)

(73) Assignee: DONGGUAN PAN AMERICAN ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 15/613,787

(22) Filed: Jun. 5, 2017

(65) Prior Publication Data

US 2018/0274774 A1 Sep. 27, 2018

(30) Foreign Application Priority Data

Mar. 22, 2017 (CN) ..... 2017 2 0291783 U
Mar. 31, 2017 (CN) ..... 2017 1 0210702

(51) Int. Cl.

| | |
|---|---|
| ***F21V 19/00*** | (2006.01) |
| ***F21V 29/76*** | (2015.01) |
| ***F21V 29/67*** | (2015.01) |
| ***F21V 21/30*** | (2006.01) |
| *F21V 21/14* | (2006.01) |
| *F21Y 115/10* | (2016.01) |
| *F21W 131/10* | (2006.01) |
| *F21W 131/103* | (2006.01) |

(52) U.S. Cl.

CPC ..... *F21V 29/76* (2015.01); *F21V 21/30* (2013.01); *F21V 29/67* (2015.01); *F21V 19/003* (2013.01); *F21V 21/14* (2013.01); *F21W 2131/10* (2013.01); *F21W 2131/103* (2013.01); *F21Y 2115/10* (2016.08)

(58) Field of Classification Search

CPC ..... F21V 29/76; F21V 21/008; F21V 19/003; F21V 29/67; F21V 17/12; F21V 21/14; F21V 21/30; F21S 8/061; F21W 2131/10; F21W 2131/103; F21Y 2115/10

See application file for complete search history.

(56) References Cited

U.S. PATENT DOCUMENTS

| | | | | |
|---|---|---|---|---|
| 9,091,424 | B1 * | 7/2015 | Mart | F21K 9/23 |
| 2010/0124058 | A1 * | 5/2010 | Miller | F21S 8/038 362/249.02 |
| 2016/0223183 | A1 * | 8/2016 | Zou | F21V 29/80 |
| 2017/0336033 | A1 * | 11/2017 | Chen | F21S 8/026 |

* cited by examiner

*Primary Examiner* — Sonji N Johnson
(74) *Attorney, Agent, or Firm* — Polsinelli PC

(57) ABSTRACT

A light source device for an outdoor lamp includes a lamp base assembly, a heat dissipation assembly, and a light source assembly. The lamp base assembly includes a retaining base having a sliding slot, a mounting member being capable of sliding along the sliding slot, and a bracket which is substantially U-shaped. The bracket is removably connected to the mounting member by a top portion thereof. The heat dissipation assembly is connected to the lamp base assembly. The heat dissipation assembly includes a heat sink connected to both ends of the bracket, and a fan connected to the heat sink. The light source assembly includes a printed circuit board connected to the heat sink and an LED chip packaged on the printed circuit board.

7 Claims, 4 Drawing Sheets

LIGHT SOURCE DEVICE FOR OUTDOOR LAMP

CROSS REFERENCE TO RELATED APPLICATION

This application claims priority to Chinese Patent Application No. 2017202917832, entitled "LIGHT SOURCE REPLACEMENT FOR OUTDOOR LAMP" filed on Mar. 22, 2017, and Chinese Patent Application No. 2017102107026, entitled " LIGHT SOURCE REPLACEMENT FOR OUTDOOR LAMP" filed on Mar. 31, 2017, the contents of which are expressly incorporated by reference herein in their entireties.

FIELD OF THE INVENTION

The present disclosure relates to lighting devices, and more particularly relates to a light source device for an outdoor lamp.

BACKGROUND OF THE INVENTION

The LED lamps, as an efficient and power saving novel light source, are edging out the old tungsten lamps and inert gas lamps. The LED lamps can be provided with different external components (lampshade and driving power etc.) when the LED lamps are used as a light source for an outdoor lamps so as to provide different functions, such as a shoe box lamp, a wall lamp, a street lamp, an awning lamp, a mining lamp and a farm lamp and so on. However, traditional LED lamps are produced singular in structure, a particular shape is designed in view of its matching external components. When the light sources of those outdoor lamps are damaged, matching LED light sources are required for the replacement, which is hard to be found and the replacement is thus difficult to be done. As such, traditional LED lamp, as a light source for an outdoor lamps, are disadvantageous in terms of universality.

SUMMARY

Therefore, it is necessary to provide a light source device for an outdoor lamp with a strong universality.

A light source device for an outdoor lamp includes a lamp base assembly, a heat dissipation assembly, and a light source assembly. The lamp base assembly includes a retaining base having a sliding slot, a mounting member being capable of sliding along the sliding slot, and a bracket which is substantially U-shaped. The bracket is removably connected to the mounting member by a top portion thereof. The heat dissipation assembly is connected to the lamp base assembly. The heat dissipation assembly includes a heat sink connected to both ends of the bracket, and a fan connected to the heat sink. The light source assembly includes a printed circuit board connected to the heat sink and an LED chip packaged on the printed circuit board.

The above and other features of the invention including various novel details of construction and combinations of parts, and other advantages, will now be more particularly described with reference to the accompanying drawings and pointed out in the claims.

BRIEF DESCRIPTION OF THE DRAWINGS

The above objects, features and advantages of the present disclosure will become more apparent by describing in detail embodiments thereof with reference to the accompanying drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

In order to make the above objects, features and advantages of the present disclosure become more apparent, the specific embodiments will be described in detail in combination with the accompanying drawings. Numerous specific details are described hereinafter in order to facilitate a thorough understanding of the present disclosure. The various embodiments of the disclosure may, however, be embodied in many different forms and should not be construed as limited to the specific embodiments set forth hereinafter, and people skilled in the art can make similar modifications without departing from the spirit of the present disclosure.

Figure 1:
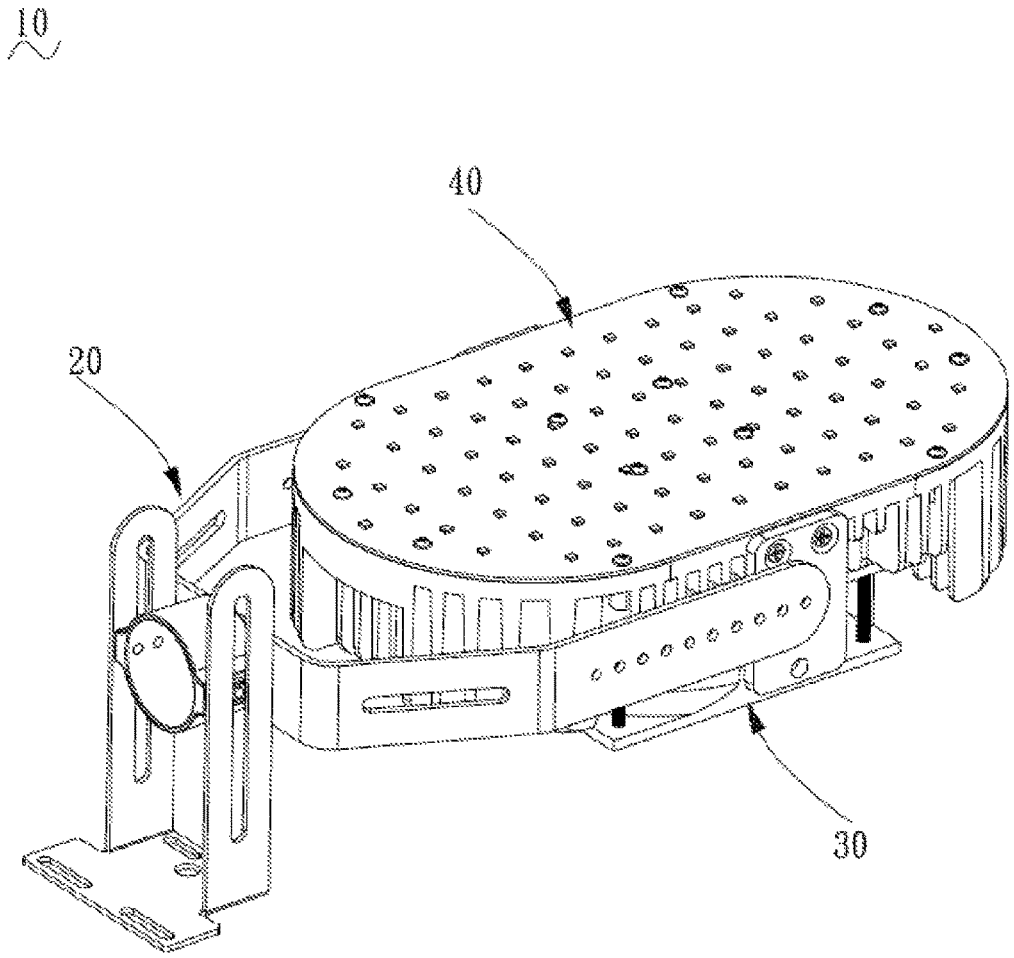
FIG. 1 is a perspective view of a light source device for an outdoor lamp according to an embodiment.
Figure 2:
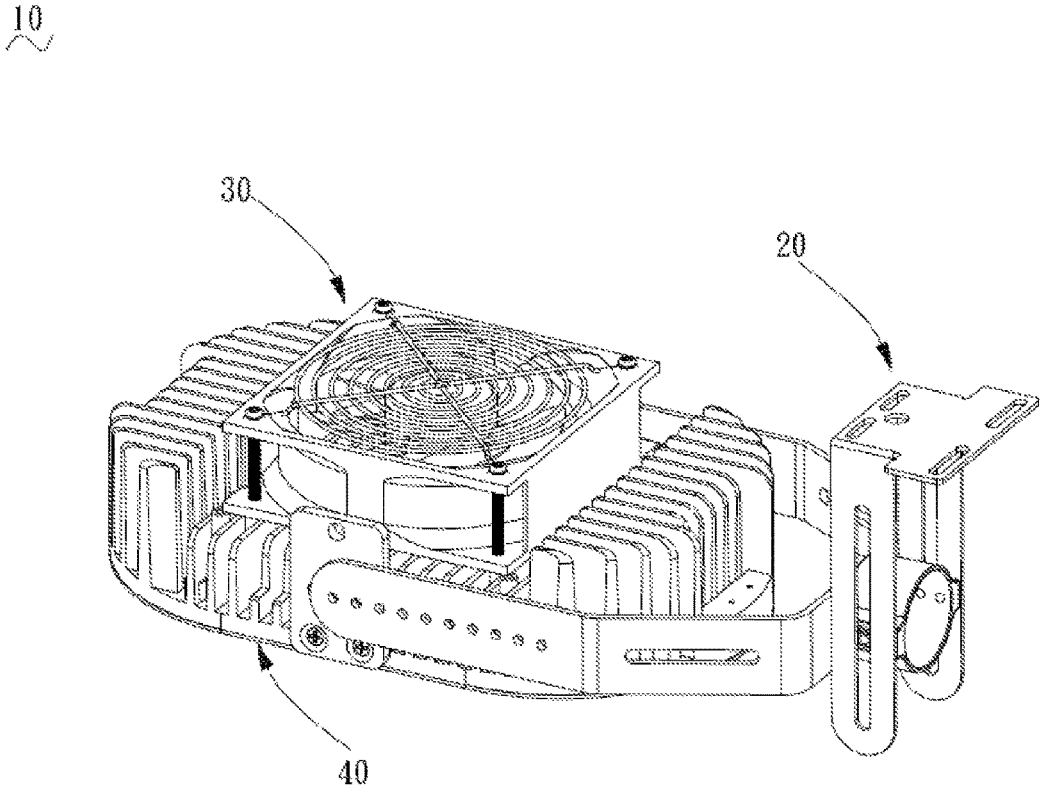
FIG. 2 is similar to FIG. 1, but viewed from another aspect.
Figure 3:
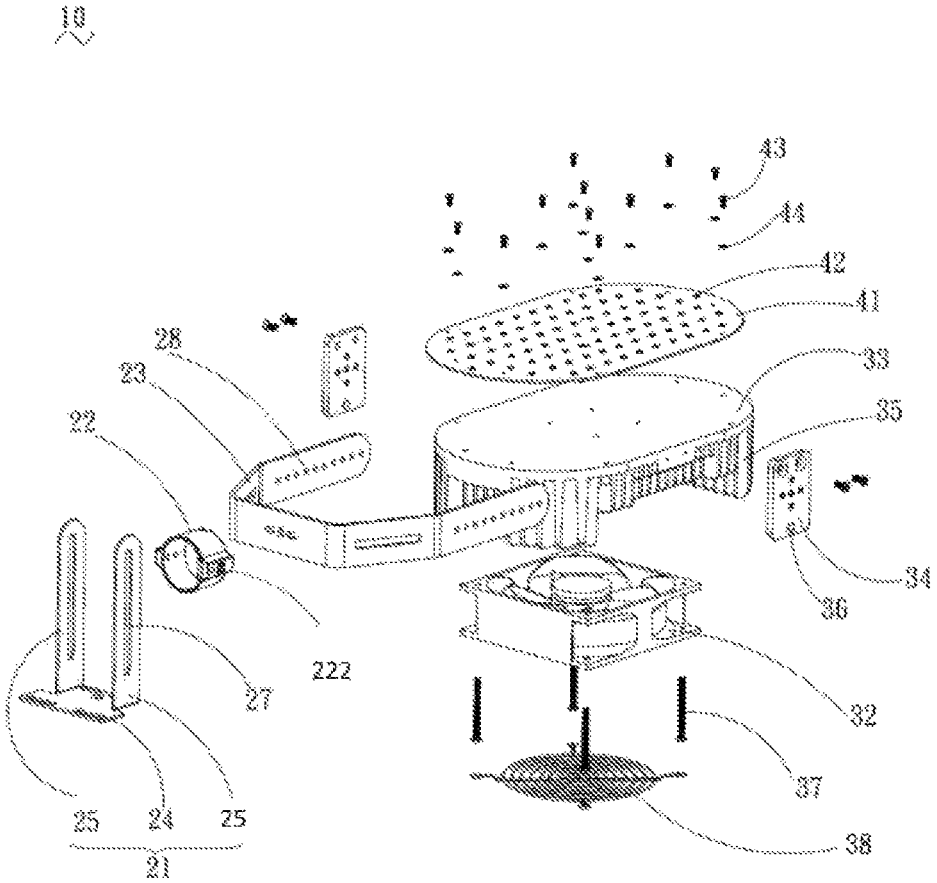
FIG. 3 is an exploded view of the light source device of FIG. 1.

Referring to FIGS. 1-3, a light source device 10 for an outdoor lamp according to an embodiment includes an lamp base assembly 20, a heat dissipation assembly 30 connected to the lamp base assembly 20, and a light source assembly 40 connected to the heat dissipation assembly 30.

The lamp base assembly 20 includes a retaining base 21, a mounting member 22 slidably connected to the retaining base 21, and a bracket 23 connected to the mounting member 22. The retaining base 21 is configured in an T shape and includes a base plate 24 and two side plates 25 connected to both sides of the base plate 24. The two side plates 25 are parallel to each other and both perpendicular to the retaining base 21. Each side plate defines a sliding slot 27 along an extending direction thereof. The mounting member is shaped substantially as a cup and provided with two sliding blocks 222 on opposite sides thereof. The mounting member 22 is located between both side plates 25 and each sliding block 222 is slidably received in the sliding slot 27.

The bracket 23 is configured in an U shape. The bracket 23 has a top portion which is releasably connected to the mounting member 22. Both ends of the bracket 23 are releasably connected to both sides of the heat dissipation assembly 30. Both ends of the bracket 23 are provided with a plurality of connection holes 28 for connecting the heat sink 31. In the illustrated embodiment, the releasable connection between the mounting member 22 and the bracket 23 as well as between the bracket 23 and the heat dissipation assembly 30 is implemented via screws.

The heat dissipation assembly 30 includes a heat sink 31 connected to both ends of the bracket 23 and a fan 32 connected to the heat sink. The heat sink 31 includes a heat sink body 33 and two fixing pieces separately connected to both sides of the heat sink body 33, respectively. The heat sink body 33 is provided with a plurality of heat sink fins 35. Each fixing piece 34 is connected to a corresponding end of the bracket 23, and each fixing piece 34 is provided with a hanging hole 36. The fan 32 is connected to the heat sink 31 by a fixing screw 37 and is provided with a dust gauze 38.

The light source assembly 20 includes a printed circuit board 41 connected to the heat sink 31, an LED chip 42 packaged on the printed circuit board 41, a screw 43, and an insulation spacer 44 sleeved on the screw 43. The printed circuit board 41 is an aluminum substrate and is connected to the fan 32. The screw 43 extends through the insulation spacer 44 and the printed circuit board 41 and is connected to the heat sink 31.

When in use, the printed circuit board 41 is coupled to an external LED driving power source to obtain the power to drive the LED chip 42 and the fan 32. The light source device 10 for the outdoor lamp can be deformed to match external components. For instance, when a shoe box lamp, a street lamp or a farm lamp is to be assembled, after the mounting member 22 is slided to an appropriate position, the bracket 23 is connected to the mounting member 22, then, according to the required illuminating angle of the lamp, the angle of the bracket 23 is adjusted with the mounting member 22 as the axis, for example, the bracket 23 is adjusted to be parallel to the base plate 24. Next, both ends of the bracket 23 are connected to the fixing pieces 34 on both sides of the heat sink 31 of the heat dissipation assembly 30, in light of the size of the current external component, an appropriate connection hole 28 in the bracket 23 is selected to be connected with the fixing piece 34. Meanwhile, the angle between the heat sink 31 and bracket 23 can be adjusted, such as adjusting the heat sink 31 to be in parallel with the base plate 24, and the light source assembly adown.

In alternative embodiments, when an awning lamp or a mining lamp is to be assembled, the posture of the LED lamp can be adjusted in two manners. In a first manner, when the mounting member 22 and the bracket 23 is being connected, the bracket 23 is adjusted to be in parallel with the first side plate 25 and the second side plate 26, and the relative angle between the bracket 23 and the heat sink 31 is adjusted in the meantime in a way that the bracket 23 is perpendicular to the heat sink 31 and the light source assembly adown. In a second manner, it is directly connected to the hanging holes 36 of the fixing pieces 34 on both sides of the heat sink 31 thru an external hanging piece, and the light source assembly 40 adown. It should be understood that by adjusting the relative positions between the mounting member 22 and the retaining base 21, between the mounting member 22 and the bracket 23, as well as between the bracket 23 and the heat sink 31, several deformations of the LED lamp can be realized so that its universality is improved. Additionally, the light source device 10 for an outdoor lamp itself can be a light source that is used independently.

According to the foregoing light source device 10 for the outdoor lamp, The mounting member 22 can slide in the sliding slot 27 of the retaining base 21 to adjust the position, and the U-shaped bracket 23 is releasably connected to the mounting member 22, such that the bracket 23 can rotate about an axis of the mounting member 22 to adjust the angle. Furthermore, both ends of the bracket 23 are respectively and releasably connected with both sides of the heat sink 31, so that the bracket 23 can rotate with the joint with the heat sink 31 as the axis and adjust the angle. Via the above configuration, a user can disassembly and deform the lamp base assembly 20 in light of particular external components of an outdoor lamp to match and assemble with different external component into outdoor lamps, wherefore the light source device 10 for an outdoor lamp can be eventually turned into a universal light source device for various outdoor lamps.

Figure 4:
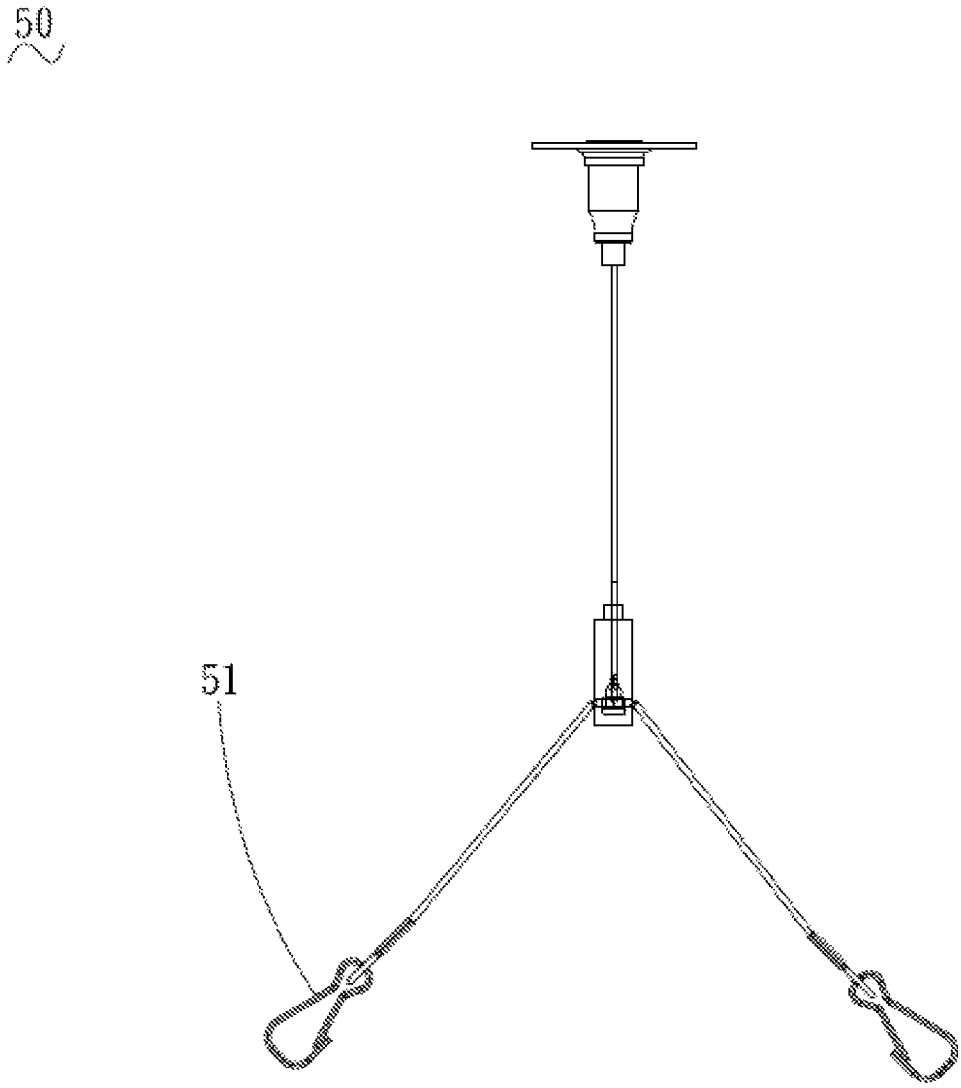
FIG. 4 is a front view of a hanging bracket of the light source device according to another embodiment.

Referring to FIG. 4, the light source device 10 for the outdoor lamp further includes an hanging bracket 50 shaped as an inverted Y. Both ends of the hanging bracket 50 are respectively configured with a hook 51 latching in the hanging hole 36. Other structures are the same with the first embodiment, and the same beneficial effect with the first embodiment can be effected.

The different technical features of the above embodiments can have various combinations which are not described for the purpose of brevity. Nevertheless, to the extent the combining of the different technical features do not conflict with each other, all such combinations must be regarded as within the scope of the disclosure.

The foregoing implementations are merely specific embodiments of the present disclosure, and are not intended to limit the protection scope of the present disclosure. It should be noted that any variation or replacement readily figured out by persons skilled in the art within the technical scope disclosed in the present disclosure shall all fall within the protection scope of the present disclosure. Therefore, the protection scope of the present disclosure shall be subject to the protection scope of the claims.

What is claimed is:

1. A light source device for an outdoor lamp, comprising:

a lamp base assembly comprising:

a retaining base having a sliding slot;

a mounting member being capable of sliding along the sliding slot, and a bracket being substantially U-shaped, wherein the bracket is provided with a at least one connection hole on both top ends thereof and has a base portion which is removably connected to the mounting member;

a heat dissipation assembly connected to the lamp base assembly, the heat dissipation assembly comprising a heat sink connected to both ends of the bracket, and a fan connected to the heat sink; and a light source assembly comprising a printed circuit board connected to the heat sink and an LED chip packaged on the printed circuit board;

wherein the heat sink comprises a heat sink body and two fixing pieces connected to both sides of the heat sink body, respectively, the sink body is provided with a plurality of heat sink fins, and each fixing piece is connected to a corresponding end of the bracket;

wherein each fixing piece is provided with a hanging hole; the light source device further comprises a hanging bracket substantially shaped as an inverted Y, and both ends of the hanging bracket are respectively provided with a hook latching in the hanging holes.

2. The light source device of claim 1, wherein the retaining base comprises a base plate and two parallel side plates connected to the base plate; the mounting member is located between both side plates and is slidably connected to both side plates.

3. The light source device of claim 1, wherein the fan is provided with a dust gauze.

4. The light source device of claim 1, wherein the light source assembly further comprises a screw and an insulation spacer sleeved on the screw, the screw extends through the insulation spacer and the printed circuit board and is connected to the heat sink.

5. The light source device of claim 1, wherein the retaining base is substantially configured in an T shape.

6. The light source device of claim 5, wherein the printed circuit board is an aluminum substrate.

7. An outdoor lamp having the light source device of claim 1, wherein the outdoor lamp is a shoe box lamp, a wall lamp, a street lamp, an awning lamp, a mining lamp or a farm lamp.

* * * * *